US007793731B2

(12) United States Patent
Boyd

(10) Patent No.: US 7,793,731 B2
(45) Date of Patent: Sep. 14, 2010

(54) ENTRY SWIVEL APPARATUS AND METHOD

(76) Inventor: Anthony R. Boyd, 1907 Vida Shaw Rd., New Iberia, LA (US) 70563

( * ) Notice: Subject to any disclaimer, the term of this patent is extended or adjusted under 35 U.S.C. 154(b) by 328 days.

(21) Appl. No.: 11/796,938

(22) Filed: Apr. 30, 2007

(65) Prior Publication Data

US 2007/0199718 A1 Aug. 30, 2007

Related U.S. Application Data

(60) Continuation-in-part of application No. 11/640,081, filed on Dec. 15, 2006, now Pat. No. 7,316,276, which is a division of application No. 10/873,038, filed on Jun. 22, 2004, now Pat. No. 7,168,498.

(51) Int. Cl.
*E21B 23/00* (2006.01)
*E21B 19/00* (2006.01)

(52) U.S. Cl. ..... 166/385; 166/77.1; 166/242.5

(58) Field of Classification Search ..... 166/385, 166/77.1, 242.5
See application file for complete search history.

(56) References Cited

U.S. PATENT DOCUMENTS

RE33,150 E 1/1990 Boyd
5,996,712 A 12/1999 Boyd
6,244,345 B1 6/2001 Helms
6,269,879 B1 * 8/2001 Boyd ..... 166/242.5
6,732,805 B1 * 5/2004 Boyd ..... 166/379
7,073,610 B2 7/2006 Susman
7,131,497 B2 * 11/2006 Helms et al. ..... 166/381
7,377,316 B2 * 5/2008 Boyd ..... 166/242.5
7,392,850 B2 * 7/2008 Boyd ..... 166/385
2006/0032638 A1 * 2/2006 Giroux et al. ..... 166/377

* cited by examiner

*Primary Examiner*—Shane Bomar
(74) *Attorney, Agent, or Firm*—Law Office of Jesse D. Lambert, L.L.C.

(57) ABSTRACT

An apparatus for use with a wireline on a drilling rig. The apparatus includes a main body having first and second entry ports, and wherein the first entry port is configured to receive the wireline. A bearing nut is operatively attached to the main body. A mandrel is partially disposed within the bearing nut, and wherein the mandrel is capable of rotating. A sleeve, disposed within a receptacle bore, is also included. The sleeve may have an inner conical surface. A method of performing wireline work is also disclosed.

20 Claims, 11 Drawing Sheets

ENTRY SWIVEL APPARATUS AND METHOD

This application is a continuation-in-part application of U.S. patent application Ser. No. 11/640,081, filed 15 Dec. 2006 now U.S. Pat. No. 7,316,276 and entitled "Side Entry Apparatus and Method", which is a divisional application U.S. patent application Ser. No. 10/873,038 (now U.S. Pat. No. 7,168,498), filed 22 Jun. 2004 and entitled "Side Entry Apparatus and Method".

This invention relates to an entry swivel apparatus. More particularly, but not by way of limitation, this invention relates to a wireline entry apparatus for use on hydrocarbon wells, and wherein the wireline entry apparatus includes a swivel.

During the course of drilling, completing and producing hydrocarbon wells, operators find it necessary to perform remedial well work. As readily understood by those of ordinary skill in the art, remedial well work includes utilizing lowering various downhole devices on wireline. A few examples of wireline operations include: running packers to a predetermined depth; perforating a subterranean reservoir; retrieving downhole devices; logging subterranean zones; setting production valves. This list was meant to be illustrative.

An apparatus that has been utilized for the entry of wireline is illustrated in U.S. Pat. No. Re. 33,150 to Harper Boyd and entitled "BOREHOLE DRILL PIPE CONTINUOUS SIDE ENTRY OR EXIT APPARATUS AND METHOD". As set out in this patent, the apparatus allows the entry of the wireline while also allowing for an axial port that is connected to the appropriate tubulars above and below the apparatus.

Nevertheless, during rigging-up and rigging-down procedures, as well as during the actual wireline operation, operators must always control the pressure of the well in order to prevent any unintended escape of the high pressure gases and fluids. As very well understood by those of ordinary skill in the art, extreme and catastrophic damage to persons and property is possible. Hence, during wireline operations, it may become necessary to rotate the drill string. However, with the prior art side entry designs, this was not possible.

Some prior art designs have sought to solve this design deficiency. For instance, in U.S. Pat. No. 5,996,712 to Harper Boyd and entitled "MECHANICAL LOCKING SWIVEL APPARATUS", a swivel is disclosed. However, the prior art designs do not disclose, nor do they teach an entry swivel apparatus and method. Therefore, there is a need for an apparatus that will allow the entry of wireline into a tubular. There is also a need for an apparatus that will allow a bottom portion to be rotated while the top portion will remain stationary. There is also a need for a swivel device that has a large open bore for placement of the wireline. Also, there is a need for an entry device that has a large open bore for placement of the wireline. These needs, as well as many others, will be met by the apparatus and method herein disclosed.

SUMMARY OF THE INVENTION

An apparatus for use with a wireline on a drilling rig is disclosed. The apparatus comprises a main body having a first entry port and a second entry port, and wherein the first entry port is configured to receive the wireline. The main body has a proximate end and a distal end, and wherein the distal end has external thread means. The main body has an internal bore having an axis and wherein the second entry port is aligned with the axis and the first entry port is aligned at an angle to the axis.

The apparatus further comprises a bearing nut having an internal thread means that engage with the external thread means of the main body, and a mandrel operatively associated with the distal end of the main body, wherein the mandrel is disposed within the bearing nut so that the mandrel is capable of rotating. The internal portion of the main body and an internal portion of the mandrel cooperate to form a receptacle bore and wherein the apparatus further comprises a sleeve disposed within the receptacle bore.

In the preferred embodiment, the mandrel and the bearing nut cooperate to form an annular cavity and wherein the apparatus further comprises a plurality of roller bearings disposed within the annular cavity in order to facilitate rotation of the mandrel. The apparatus may further include a first seal means, disposed about the sleeve and engaging the internal portion of the main body, for sealing the internal portion of the main body. A second seal means, disposed about the sleeve and engaging the internal portion of the mandrel, for sealing the internal portion of said mandrel may also be provided.

In one preferred embodiment, an internal bore of the sleeve contains a conical surface, and wherein the internal bore has a neck and a throat and wherein the neck has a larger inner diameter than the throat. Also, the sleeve may contain a shoulder for engaging an indentation on an internal portion of the main body, and wherein the shoulder is capable of keeping the sleeve in place so as the mandrel is rotated, it will rotate around the sleeve and packing, as the sleeve is held in place by the notches. As per the teachings of the present disclosure, in one embodiment, the second entry port is connected to a top drive of the drilling rig and the mandrel is connected to a drilling string.

In the preferred embodiment, the outer diameter of the main body forms a cylinder and wherein the inner diameter of the main body also forms a cylinder, and wherein the outer diameter of the main body is parallel with the inner diameter of the main body so that a fully opened inner diameter bore is formed.

A method of performing wireline work on a drilling rig is also disclosed. The method including providing a entry tool, wherein the entry tool comprises: a main body having a first entry port and a second entry port, wherein the first entry port is configured to receive the wireline; a distal end of the main body having external threads; a bearing nut having an internal threads that engage with the external threads of said main body; a mandrel operatively associated with the distal end of the main body, wherein the mandrel is disposed within the bearing nut so that the mandrel is capable of rotating, and wherein an internal portion of the main body and an internal portion of the mandrel cooperate to form a receptacle bore; a sleeve disposed within the receptacle bore; a plurality of roller bearings disposed within an annular cavity formed between the mandrel and the bearing nut.

The method further comprises connecting the second entry port to a top drive of the drilling rig, connecting the mandrel to a drilling string, and lowering a downhole tool on the wireline. The method further includes rotating the drilling string via the plurality of roller bearings, rotating the mandrel about the plurality of roller bearings, and maintaining the main body stationary. In a preferred embodiment, the step of lowering the tool on the wireline includes protecting the wireline from being cut on a chamferred surface contained on the mandrel.

An advantage of the present invention includes the apparatus has dual entry points, with one entry port for wireline. Another advantage is that the bottom section swivels while the top portion may be connected to the traveling block of a drilling rig. Yet another advantage is that the device can be used in order to rig-up, rig-down, or during actual remedial well work. In other words, the operator can use the device whenever the operator needs to rotate the work string below the entry tool.

A feature of the present apparatus and method is that the main body has large inner bore. Yet another feature is that the sleeve protects wireline from getting cut during rotating operating procedures. Yet another feature is the roller thrust bearing that facilitate the rotation of the bottom swivel. Still yet another feature is the seal means that ensure containment of pressure from the subterranean reservoirs. Still yet another feature is the notch on sleeve that will engage with the main body so that when the mandrel rotates, the sleeve is held stationary; otherwise, the wireline runs the risk of being cut when the mandrel is rotated since the sleeve would have a tendency to also want to rotate, thereby enhancing the chance of the wireline being cut.

In another embodiment herein disclosed with this application, an apparatus for transferring torque comprising a central body, with the central body having a central passage. The apparatus further comprises a first plurality of splines formed within the central passage and a bottom sub that cooperates with the central passage, with the bottom sub being connected to the well. The apparatus further comprises a second plurality of splines formed on the bottom sub, and wherein the first plurality of splines and the second plurality of splines cooperate to engage and transfer the torque applied to the central body.

The apparatus may further comprise a third plurality of splines formed within the central passage, a top sub that cooperates with the central passage, and a fourth plurality of splines formed on the top sub that cooperates to engage and transfer the torque applied to the central body with the third plurality of splines. In one of the preferred embodiments, the top sub is connected to a top drive of a rig.

The apparatus may further comprise a first threaded cap engaging first thread means contained on the central body and wherein the first threaded cap contains an opening in communication with the central passage. A wireline is disposed within the opening. A second threaded cap may be included, with the second threaded cap engaging a second thread means contained on the central body. In one preferred embodiment, the first threaded cap contains a second opening in communication with the central passage for pumping a fluid into the central passage.

The apparatus may further comprise first seal means, disposed within the central body and operatively engaging the bottom sub, for sealingly engaging with the central passage, and second seal means, disposed within the central body and operatively engaging the top sub, for sealingly engaging with the central passage. In one preferred embodiment, the first and second openings are at acute angles relative to the central passage and a side entry tube is operatively associated with each opening for placement of a wireline or coiled tubing.

Also disclosed is a method of performing wireline work on a rig, wherein a well extends from the rig. The method comprises providing an apparatus comprising a central body, the central body having a central passage; a first plurality of splines formed within the central passage; a top sub that cooperates with the central passage, the top sub being connected to the well; a second plurality of splines formed on the top sub; a first threaded cap engaging the first thread means contained on the central body and wherein the first threaded cap contains an opening in communication with the central passage; a second threaded cap engaging a second thread means contained on the central body.

The method further comprises providing a wireline through the opening and into the central passage, and wherein the wireline has a down hole tool attached at a first end, and the down hole tool is in the well. The method includes lowering the down hole tool into the well on the wireline.

The method may further comprise transmitting a torque to the top sub and in turn transmitting the torque to the first plurality of splines. In one preferred embodiment, the apparatus comprises a second plurality of splines, and the method further comprises transmitting the torque to the top sub and in turn transmitting the torque to the second plurality of splines.

Additionally, in one preferred embodiment, the apparatus may further comprise a seal means, operatively disposed about the bottom sub, for sealingly engaging with the central passage, and the method further comprises sealing a down hole pressure from the well within the central passage. Also, the method may include pumping a fluid through the top and bottom sub, and into the well.

In one embodiment, the first cap contains a second opening and the method further provides a second wireline disposed through the second opening, and the method further comprises lowering a second down hole tool into the well.

In yet another embodiment, an apparatus for transferring a torque is disclosed that includes a central body having a central passage and an acute passage that is in communication with the central passage. The apparatus further includes a first plurality of splines formed within the central passage and a top sub that cooperates with the central passage. A second plurality of splines is formed on the top sub, and wherein the first and second plurality of splines cooperate to engage and transfer the torque applied to the central body. The apparatus further includes a bottom sub that cooperates with the central passage and means, disposed about an outer portion of the bottom sub, for allowing rotation of said bottom sub relative to said central body. The means for allowing rotation may comprise a plurality of roller bearings.

An advantage of the present invention is that the apparatus will prevent the over torquing of a tubular. Another advantage is that the apparatus can be used as a side entry tool on a rig drilling a well. Yet another advantage is that the invention allows a significant amount of torque be applied to the apparatus without damaging the apparatus. Still yet another advantage is that the apparatus will result in safer connections since the connections will not be over torqued.

A feature of the present invention includes the splines on the body portion will engage and cooperate with splines on the bottom sub portion. Another feature is that the torque is applied only to the spline. Another feature is that multiple apertures may be provided for multiple entry points. Yet another feature is that the central passage can contain a large flow through bore. Yet another feature is the seal means contain the pressure from the well.

Another feature is that the length of the tool is shorter than prior art devices. The novel side entry device also cost less to manufacture and takes less time to manufacture. Yet another feature is that no make-up torque is required on the connections. Still yet another feature is that one embodiment has two openings, one for wireline entry, and a second for pumping. In still another embodiment, an upper part of the tool can have spline means for transferring torque and the lower part of the tool may comprise means for allowing rotation of the lower part of the tubular string.

DETAILED DESCRIPTION OF THE PREFERRED EMBODIMENTS

Figure 1:
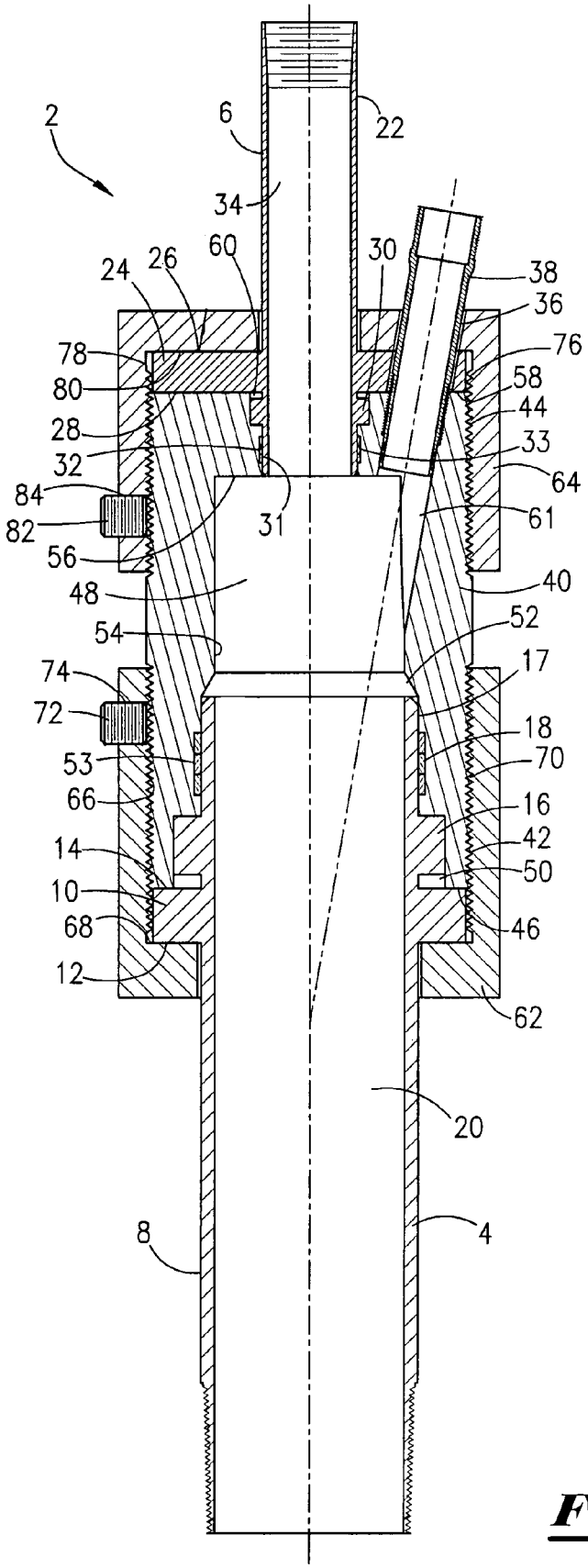
FIG. 1 is a cross sectional view of the preferred embodiment of the present invention.

Referring now to FIG. 1, a cross sectional view of the preferred embodiment of the present invention will now be described. The apparatus 2, which is sometimes referred to as a side entry tool 2, will have a bottom sub 4, which may be referred to as a lubricator 4, attached at one end and a top sub 6, which may be referred to as a top lock joint 6, attached at the opposite end. In one preferred embodiment, the bottom sub 4 will be attached to a well and the top sub 6 will be attached to the top drive of a rig, as will be explained in greater detail later in the application.

The lubricator 4 has an outer diameter surface 8 that extends to the radial shoulder 10, wherein the radial shoulder 10 has a first side 12 and a second side 14. The second side 14 of the radial shoulder 10 extends to a plurality of splines 16, sometimes referred to as spline teeth 16. Extending from the plurality of splines 16 is seal bore 17 for cooperating with seal means 18, such as v-packing 18, with v-packing being commercially available from Industrial Rubber Products Inc. under the name Poly Pack. The bottom sub 4 will have an internal bore 20.

The top sub 6 has an outer diameter surface 22 that extends to the radial shoulder 24 and wherein the radial shoulder 24 has a first side 26 and a second side 28. The second side 28 of the radial shoulder 24 extends to the plurality of splines 30, which are sometimes referred to as spline teeth 30. The plurality of splines 30 extends to seal bore 31 formed on the outer diameter surface 22 for cooperation with seal means 32, such as v-packing 32. The v-packing 32 is contained within an inner surface 33. The joint 6 will have an internal bore 34. The radial shoulder 24 contains an angled bore 36. The bore 34 will be operatively associated with side entry tube 38 as follows: side entry tube 38 extends through the cap 64, through the angle bore 36 of the radial shoulder 24, through a mandrel 40, and communicates with the internal portion of the mandrel 40 and bore 20. The side entry tube 38 is at an acute angle relative to the center line of bore 20.

The mandrel 40 is generally cylindrical having a first outer thread means 42 and second outer thread means 44. The mandrel 40 has a first radial end 46, wherein radial end 46 abuts the second side 14. Extending radially inward, the mandrel 40 has an internal bore 48 and wherein the internal bore 48 is aligned with the bore 20 and the bore 34. The internal bore 48 has formed thereon a receptacle spline means 50 that will cooperate and engage with the plurality of splines 16. The internal bore 48 has a first chamfered surface 52 that extends to the inner diameter surface 54. An indentation 53 is formed for placement of the seal means 18, and wherein seal means 18 cooperates with seal bore 17. The inner diameter surface 54 in turn extends to the radial surface 56.

The mandrel 40 has a second radial end 58, wherein radial end 58 abuts the second side 28. The internal bore 48 also has formed thereon a receptacle spline means 60 that will cooperate and engage with the plurality of splines 30. The mandrel 40 will also have an inner indentation 33 for placement of the v-packing seal means 32. The mandrel 40 has angled bore 61 for alignment with the side entry tube 38 so that the tube 38 is in communication with the internal bore 20 which is the passageway for the wireline. In this way, the wireline can enter into the bore 20 and into the well, as will be explained in greater detail later in the application.

In addition to the cap 64, the apparatus 2 also contains a cap 62 and wherein both caps are generally cylindrical. The cap 62 has an inner surface 66 that extends to the radial surface 68 and wherein radial surface 68 abuts the first side 12 of the radial surface 10 as seen in FIG. 1. The thread means 70 on the cap 62 will engage the thread means 42 on the mandrel 40. A lock nut 72 through the opening 74 is included so that the cap 62 is locked into place with the mandrel 40.

Additionally, FIG. 1 depicts that the thread means 76 of the second cap 64 will engage the second outer thread means 44 so that the cap 64 is in place relative to the mandrel 40. The cap 64 has an inner surface 78 that extends to the radial surface 80 and wherein radial surface 80 abuts the first side 26 of the radial shoulder 24. A lock nut 82 through the opening 84 is included so that the cap 64 is locked into place with the mandrel 40.

Figure 2:
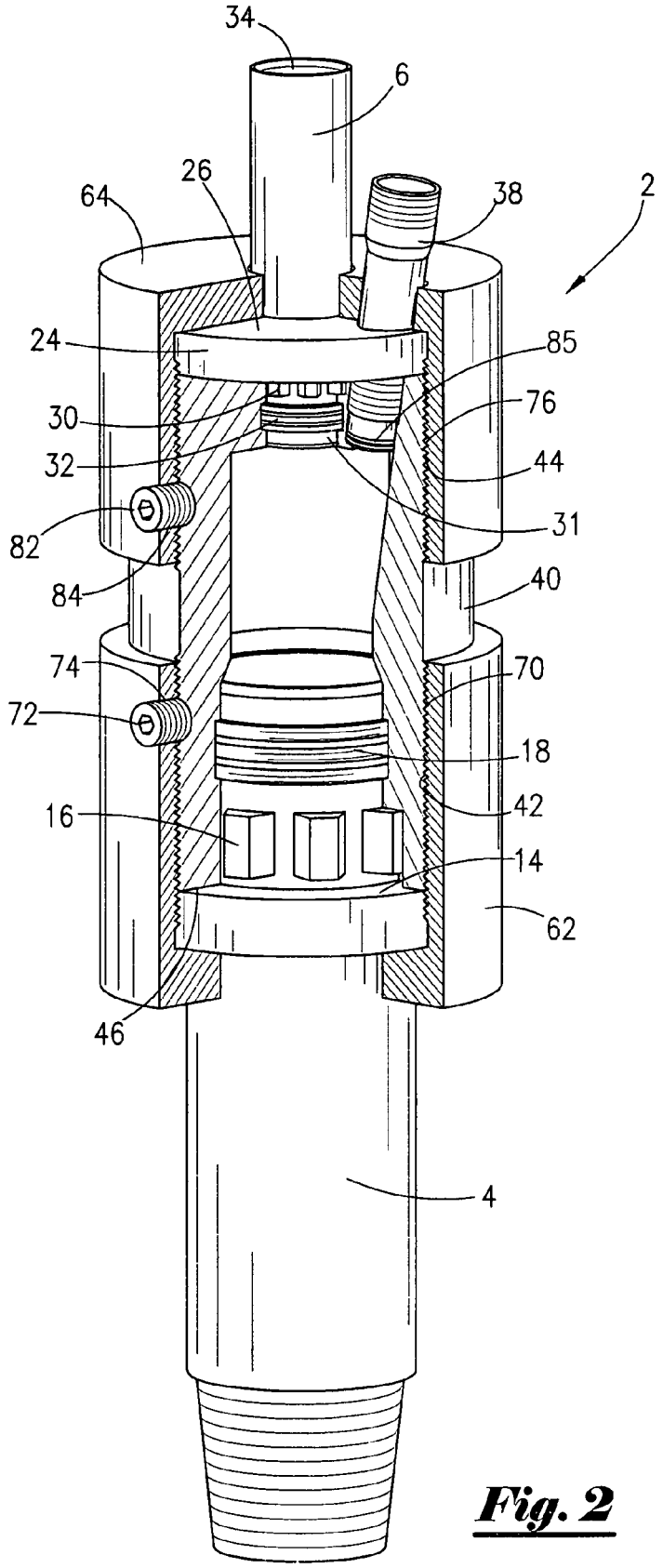
FIG. 2 is an isometric partial cross sectional view of the preferred embodiment seen in FIG. 1.

Referring now to FIG. 2, an isometric partial cross sectional view of the preferred embodiment of the invention seen in FIG. 1 will now be described. It should be noted that like numbers appearing in the various figures refer to like components. The cap 64 is seen, wherein the thread means 76 are engaging the thread means 44. The plurality of splines 30 is shown along with the seal means 32, and wherein the seal means 32 will engage with the inner diameter surface 31 of the mandrel 40. The first side 26 of radial shoulder 24 abuts the inner portion of cap 64. The side entry tubular 38 and the o-ring 85 will cooperate with bore 61. The o-ring 85 is commercially available from Industrial Rubber Products Inc. under the name O-ring.

The cap 62 is shown engaged with mandrel 40 and wherein the thread means 70 are engaged with the thread means 42, and the second side 14 abuts the first radial end 46 of mandrel 40. The plurality of splines 16 is shown along with the seal means 18 which will sealingly engage the inner diameter surface of the mandrel 40. FIG. 2 further depicts the side entry tubular 38 for entry of the wireline, or tools, or coiled tubing. It should be noted that the threads on caps 64 and 62 will be, in the preferred embodiment, right handed threads.

Figure 3:
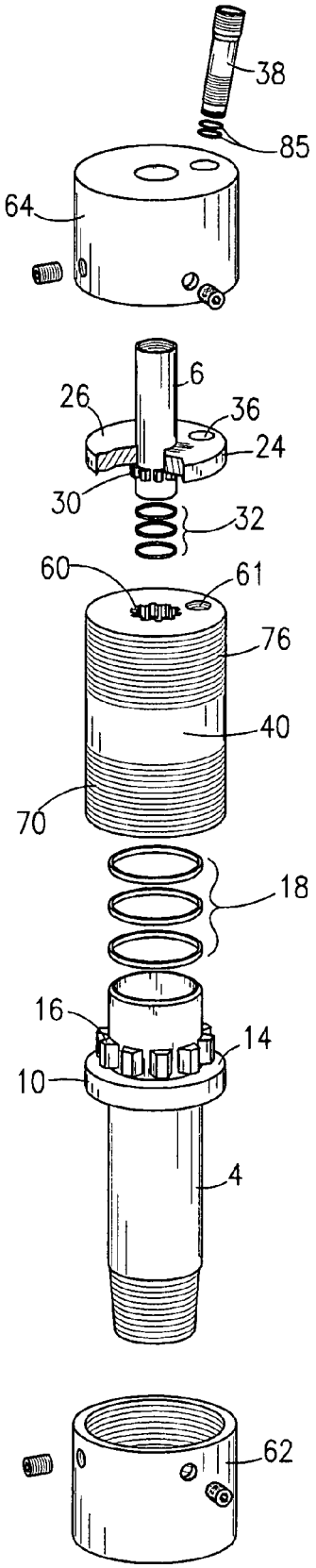
FIG. 3 is an exploded view of the preferred embodiment seen in FIG. 1.

In FIG. 3, an exploded view of the preferred embodiment seen in FIG. 1 is illustrated. Hence, the seal means 32 will be fitted into the indentation 33 (not seen in this view) on the mandrel 40. FIG. 3 depicts the plurality of splines 30 as well as the receptacle spline means 60. The cap 64 will threadedly attached with the thread means 76 of mandrel 40. The seal means 18 will be fitted into the indentation 53 (not seen in this view) on the mandrel 40. FIG. 3 further depicts the plurality of splines 16 which will engage with the receptacle spline means 50 (spline means 50 not shown in this view). The cap 62 will threadedly attached with the thread means 70 of mandrel 40. The side entry tubular 38 is also shown.

Figure 4:
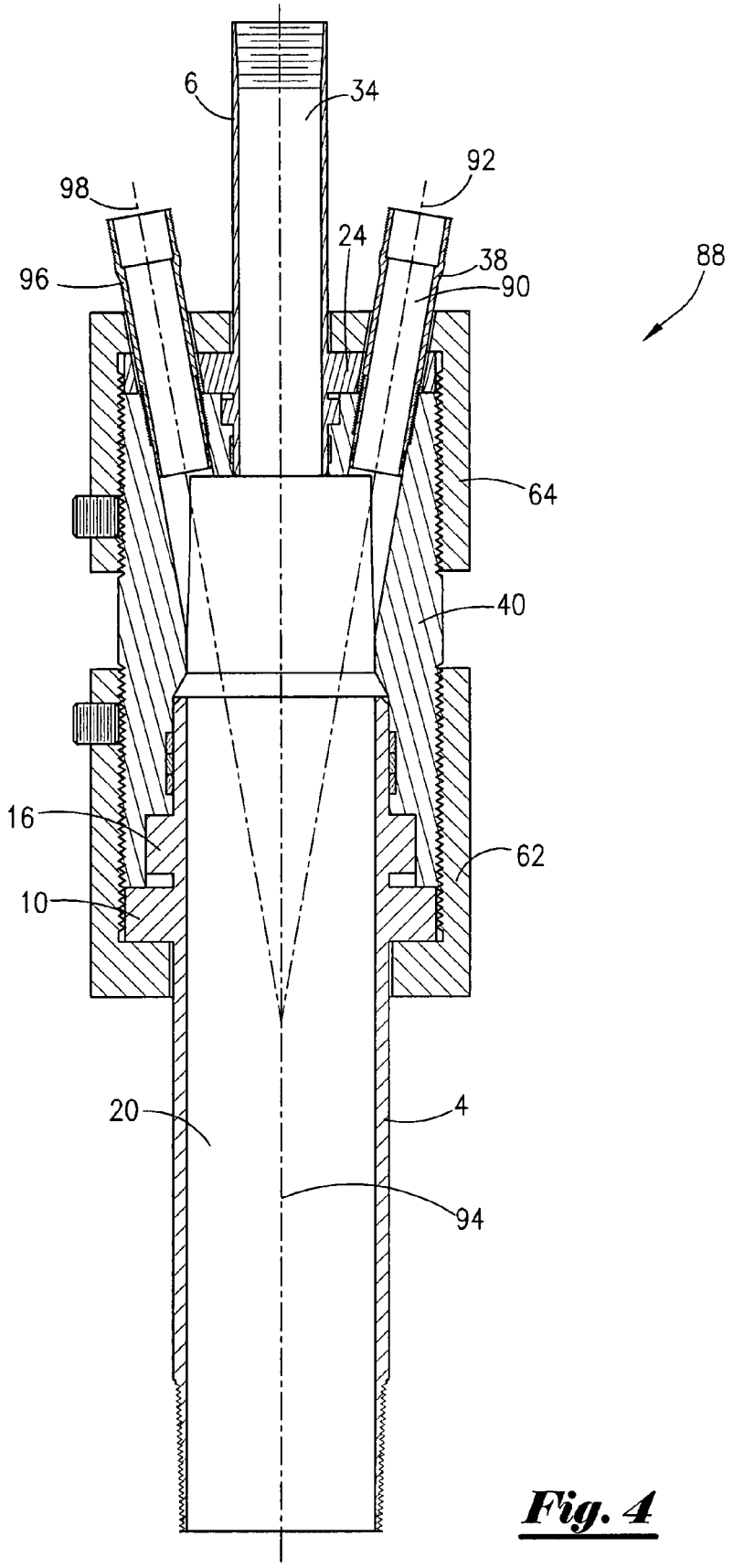
FIG. 4 is a cross sectional view of a second embodiment of the present invention.

FIG. 4 is a cross sectional view of a second embodiment of the present invention. The apparatus 88 contains the first side entry tube 38 for entry of a wireline, as previously described. The side entry tube 38 has a central bore 90 for placement of a wireline (not seen in this view). As seen in FIG. 4, the center line 92 will intersect with the center line 94 of the bore 20. A second side entry tube 96 is shown, wherein the second side entry tube 96 is of similar construction with the first side entry tube 38, wherein side entry tube 96 extends through the cap 64, through the radial shoulder 24 and through the mandrel 40 and communicates with the internal portion of the mandrel 40 and bore 20. The second side entry tube 96 has a center line 98 that will also intersect with the center line 94 of the bore 20. Hence, the second embodiment seen in FIG. 4 allows the entry of a fluid, for instance, that can be pumped down into the bore 20. The second side entry tube 96 can also be used to pump down a wireline tool, or the tube 96 can actually be used as an entry point for a second wireline. Note that the tube 96 is at an angle, and therefore, the centerline 98 is at this angle which facilitates entry into bore 20.

Figure 5:
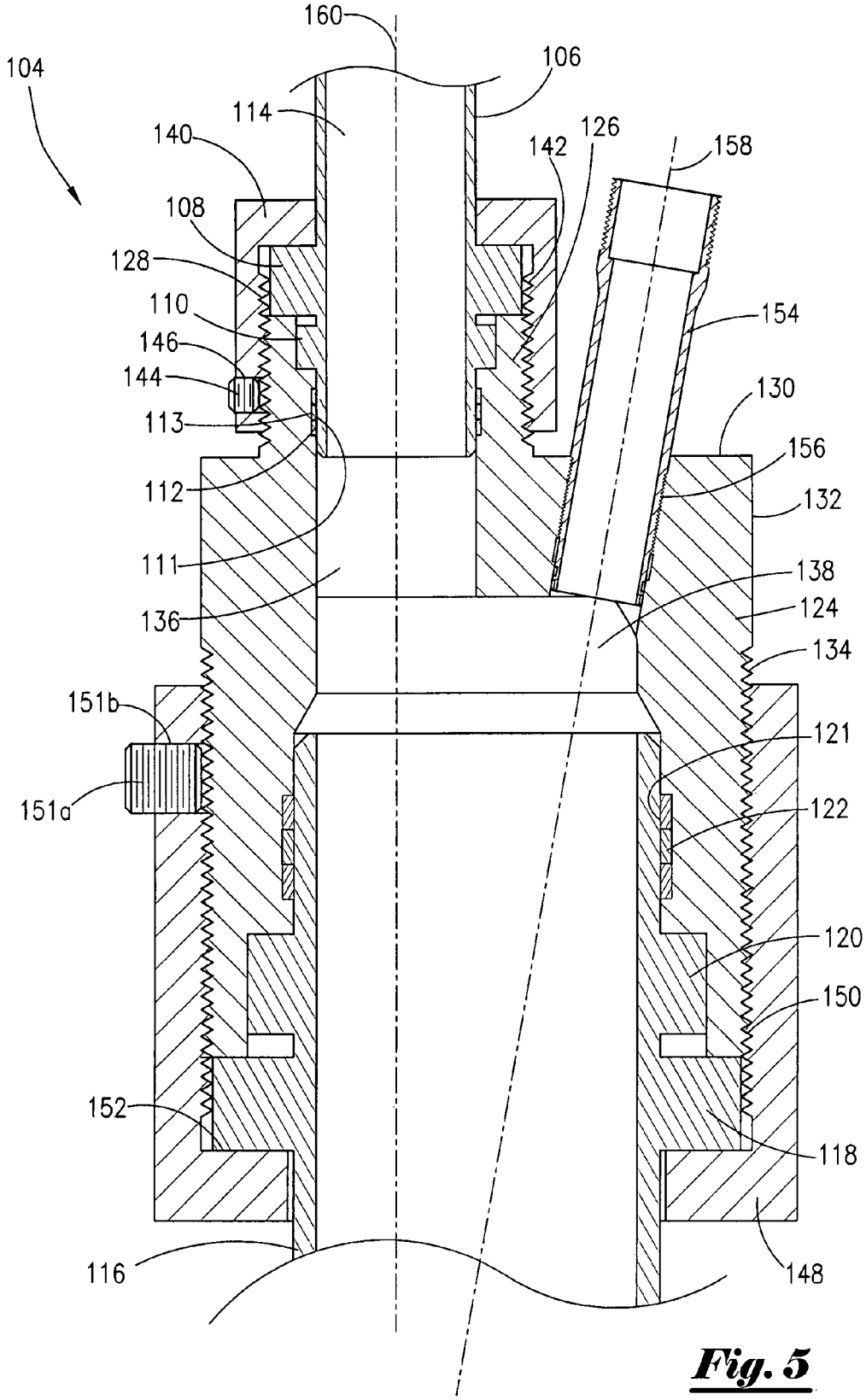
FIG. 5 is a cross sectional view of a third embodiment of the present invention.

Referring now to FIG. 5, a cross sectional view of a third embodiment of the present invention. The apparatus 104 includes a top sub 106 that contains a radial shoulder 108 that then extends to a plurality of splines 110, and concludes with a seal bore 111 that cooperates with seal mean means 112, and wherein the seal means 112 are contained within an indentation 113 on mandrel 124. The top sub 106 has an internal bore 114. The apparatus 104 also contains a bottom lubricator 116, and wherein the bottom lubricator 116 has a radial shoulder 118 that extends to a plurality of splines 120. From the plurality of splines 120, the bottom lubricator 116 has a seal bore 121 that cooperates with seal means 122 located within an indentation in mandrel 124.

The apparatus 104 includes a mandrel 124, and wherein the mandrel 124 is generally cylindrical. The mandrel 124 contains a top neck portion, seen generally at 126. The top neck portion 126 contains external threads 128 that in turn extends to shoulder 130. As shown in FIG. 5, the top neck portion 126 is off-centered [eccentric]. From the shoulder 130, the outer cylindrical portion 132 extends to the external threads 134. The top neck portion 126 includes a first inner bore 136 wherein the first inner bore 136 will contain a set of reciprocal splines that will engage with the splines 110 of the top sub 106. The first inner bore 136 extends to the second inner bore 138, and wherein the second inner bore 138 will contain a set of reciprocal splines that will engage with the splines 120 of the bottom lubricator 116. Note that the inner diameter of the second bore 138 is greater that than the inner diameter of the first bore 136 due to the shoulder 130 that is formed due to the off-centered orientation of the top neck portion 126.

The apparatus 104 further includes a top cylindrical cap 140 that includes internal thread means 142 that will engage with the external threads 128 of the top neck portion 126. The top cap 140 will have a lock nut 144 through opening 146 in order to hold in place. The apparatus 104 also includes the lower cylindrical cap 148, and wherein the cap contains an internal portion having thread means 150 that will engage with the external thread means 134 of the mandrel 124. A lock nut 151*a* that is disposed through opening 151*b* will lock the cap 148 onto the mandrel 124. Note that the cap 148 has a bottom radial ledge 152, and wherein the bottom radial ledge 152 engages the radial shoulder 118 to keep the splines in engagement, as previously discussed.

A side entry tube 154 is included, and wherein the side entry tube 154 is sealingly disposed through an angled bore 156 through the shoulder 130 of the mandrel 124. As seen in FIG. 5, the side entry tube 154 has an internal center line 158 that will intersect the center line 160 of the top lubricator 106. As per the teachings of the present invention, a wireline can be entered into the bottom lubricator 116. As shown, the splines 110 of the top sub 106 are engaged with the upper splines of the mandrel and the splines 120 of the bottom lubricator 116 are engaged with the lower splines of the mandrel 124 and a torque can be applied.

Figure 6:
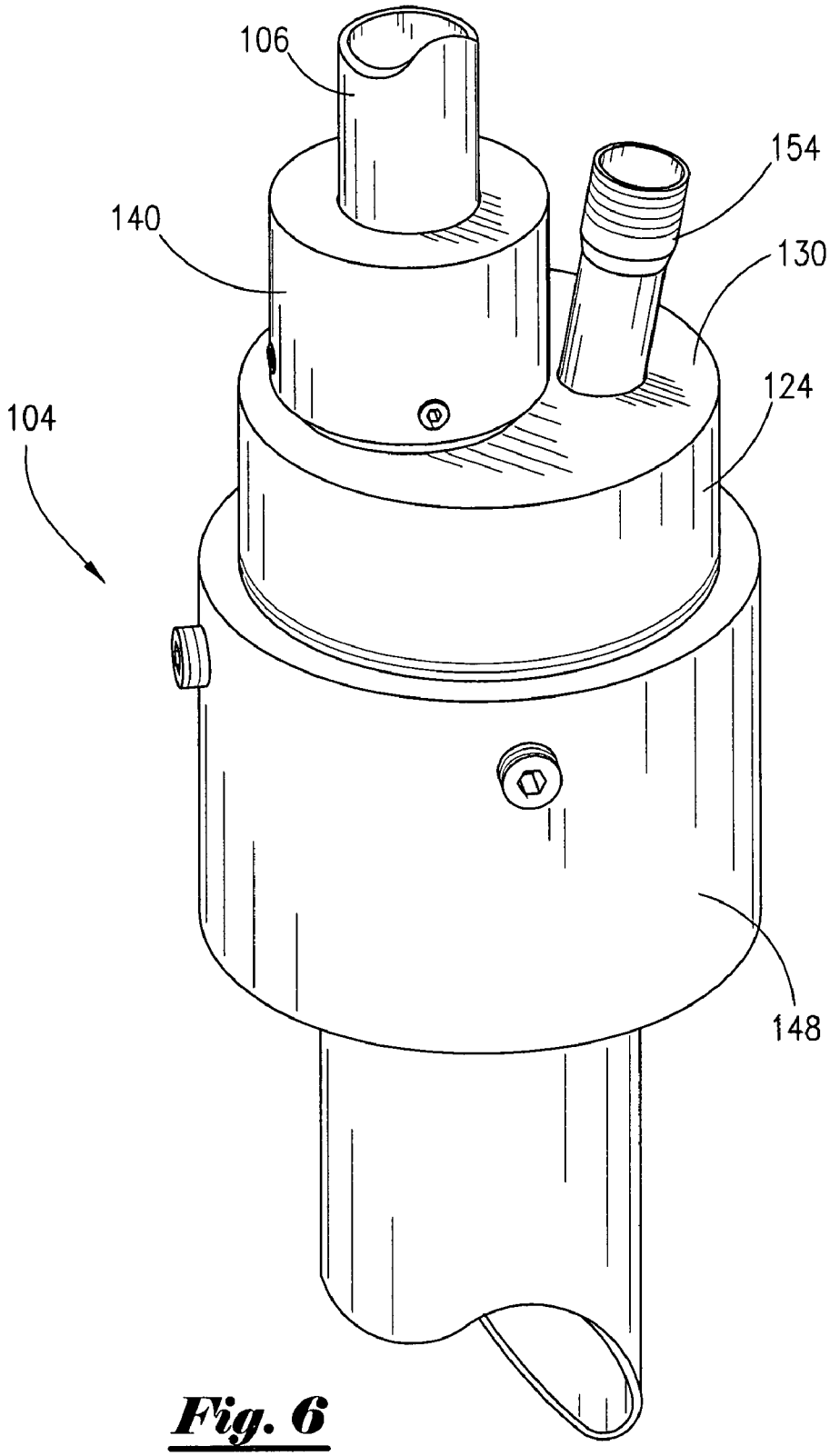
FIG. 6 is an isometric view of the third embodiment seen in FIG. 5.

In FIG. 6, an isometric view of the third embodiment seen in FIG. 5 is illustrated. Hence, the top cap 140 is shown secured onto the mandrel 124, as well as the bottom cap 148 being secured to the mandrel 124. Both caps (140, 148) are secured with the threads and locking nuts, as previously described.

Figure 7:
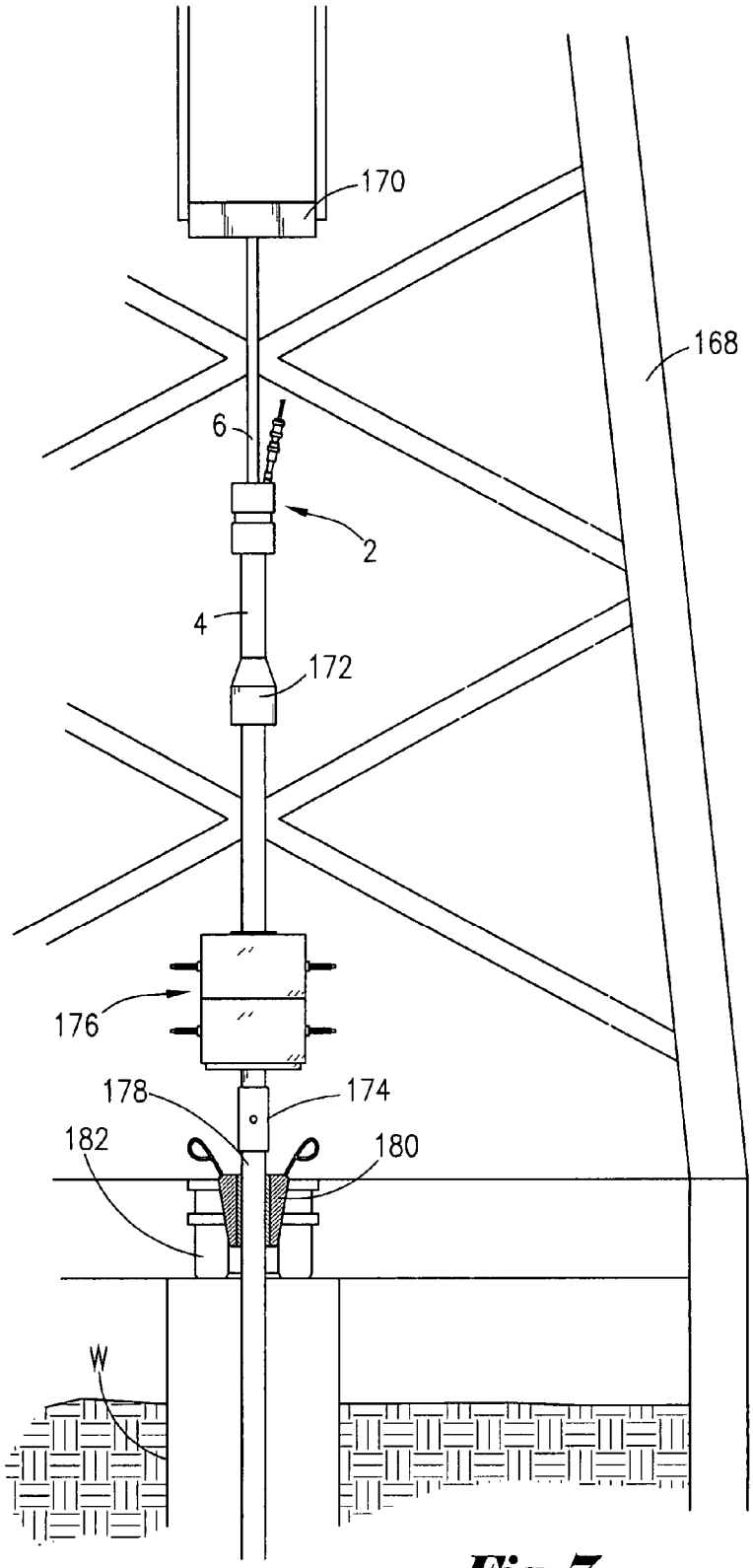
FIG. 7 is a schematic view of the present invention rigged up in the derrick of a rig.

Referring now to FIG. 7, a schematic view of the present invention rigged up in the derrick 168 of a rig will now be described. More specifically, the apparatus 2 is shown rigged up, and wherein the top sub 6 is connected to a top drive mechanism 170 wherein the top drive mechanism 170 can be used for transmitting torque to the entire surface and down hole assembly as is well understood by those of ordinary skill in the art. The bottom lubricator 4 is attached to a locking swivel 172. The locking swivel 172 can allow for the rotation of the assembly, or alternatively, the locking swivel 172 can be locked so that torque is transmitted there through. The locking swivel 172 is commercially available from Boyd's Rental Tools Inc. under the name WHES.

A ball valve 174 is included in the embodiment shown in FIG. 7. The ball valve 174 has an open and closed position in order to prevent pressure from well W to escape to the atmosphere. Also, FIG. 7 shows the blow out preventor means (BOP) 176, wherein the BOP 176 will contain means to seal off pressure from well W and wherein the BOP 176 is specifically applicable for use with a wireline concentrically disposed therein. The BOP 176 may be the type disclosed by applicant, bearing Ser. No. 10/613,716 entitled "High Torque and High Capacity Rotatable Center Core with Ram Body Assemblies" filed on 3 Jul. 2003, which is incorporated herein by express reference. FIG. 7 depicts that the tubular work string 178 that extends from the BOP 176 into the slip means 180 within the drill rig's rotary table 182. As understood by those of ordinary skill in the art, the slip means 180 support the tubular string 178 within the well W. Also, the rotary table 182 can be rotated in order to rotate the work string in some instances.

In operation, the entire apparatus 2 can be rotated, and according to the teachings of the present invention, the torque will be transmitted by the spline means, namely splines 16 and 30 which were seen in FIGS. 1 and 2. The torque can be applied to the top lock joint 6 or transmitted to the bottom lubricator 4.

In the prior art, once torque was applied to the side entry tool, the threads of the side entry sub could be sheared, or other structural damage could occur to the side entry tool body, which are both dangerous scenarios. Hence, the present invention solves these problem, and many others, by being able to transmit torque to the splines as previously described. Prior art tools have drill pipe type of threads with no way of sealing except metal-to-metal (via the threads). The threads have to be torqued-up by crew on the rig floor with rig tongs to a specific torque in order to maintain the seal as well as preventing the threads from unscrewing. In the present invention, torque is applied to the splines, and no torque is applied to the outer threads, yet a seal is effected via seal means 18, 32.

Figure 8:
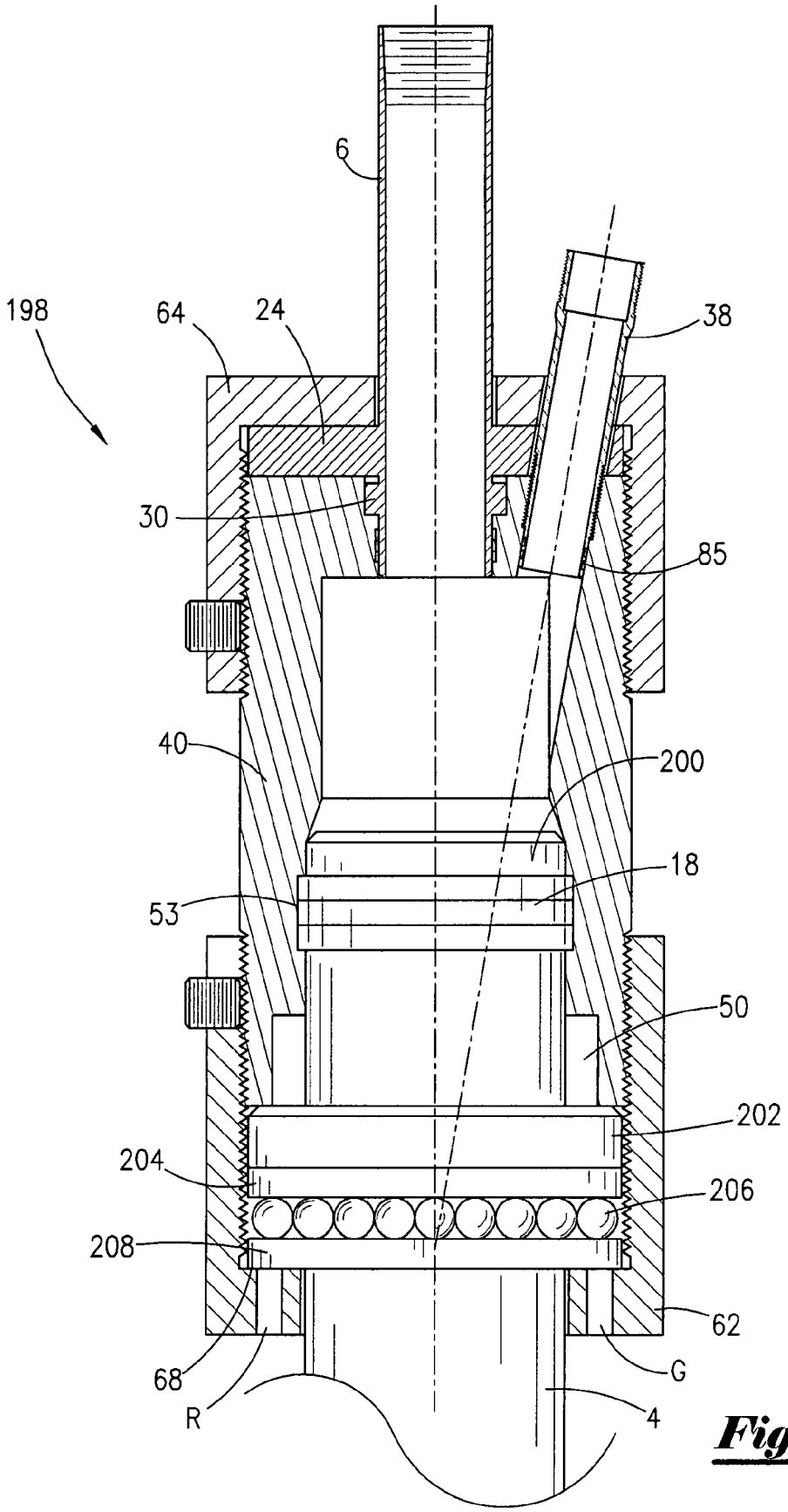
FIG. 8 is a cross-sectional view of a fourth embodiment of the present invention.

Referring now to FIG. 8, a cross-sectional view of the fourth embodiment of the side entry tool 198 will now be described. As noted earlier, like numerals appearing in the various figures refer to like components. In this embodiment, the bottom sub 4, sometimes referred to as the lubricator sub 4, contains a top outer portion 200 that extends to a radial shoulder 202 which in turn extends to the bottom sub 4. The cap 62 is provided, and wherein the cap 62 is threadedly attached to the mandrel 40 as previously described. In the preferred embodiment, the cap 64 may be of a "right-handed" thread make-up, while the cap 62 will be the "left-handed" thread make-up due to the side entry tool 198 swiveling nature.

As seen in FIG. 8, the rotating means for allowing the rotation of the bottom sub 4, relative to the cap 64 and top sub 6, is positioned below the radial shoulder 202. In one preferred embodiment, the rotating means consist of a first disc 204, a series of roller bearings 206, and a second disc 208. The first disc 204 abuts the radial shoulder 202 and the second disc 208 abuts the radial surface 68 of the cap 62, with the roller bearings 206 being positioned between the first disc 204 and the second disc 208. The cap 62 further contains a grease injection port G as well as a relief port R. The remainder of the upper part of the side entry tool 2 remains the same as the previously discussed embodiments. For instance, in the preferred embodiment of FIG. 8, the operator will use the previously described mandrel 40, cap 64 and top lock joint 6 which allows for interchangeability between embodiments—only the bottom sub 4 of FIG. 8 will have to be changed out.

The side entry tool 198 with a splined connection allows the side entry of a wire line string, as previously described. Additionally, the embodiment of FIG. 8 will also allow the bottom sub 4 to rotate while allowing the upper part to remain stationary. Torque can be applied to the top sub 6, which is imparted to the splines 30, and which in turn will be transmitted to the splines 60 located on the central passage of the mandrel 40, as previously described. It should be noted that if the embodiment of the side entry tool 198 described in reference to FIG. 8 is used, then an operator will opt to leave out the locking swivel (such as the swivel 172 shown in FIG. 7). In other respects, the operation described with reference to FIG. 7 is also applicable to the embodiment discussed with reference to FIG. 8.

Figure 9:
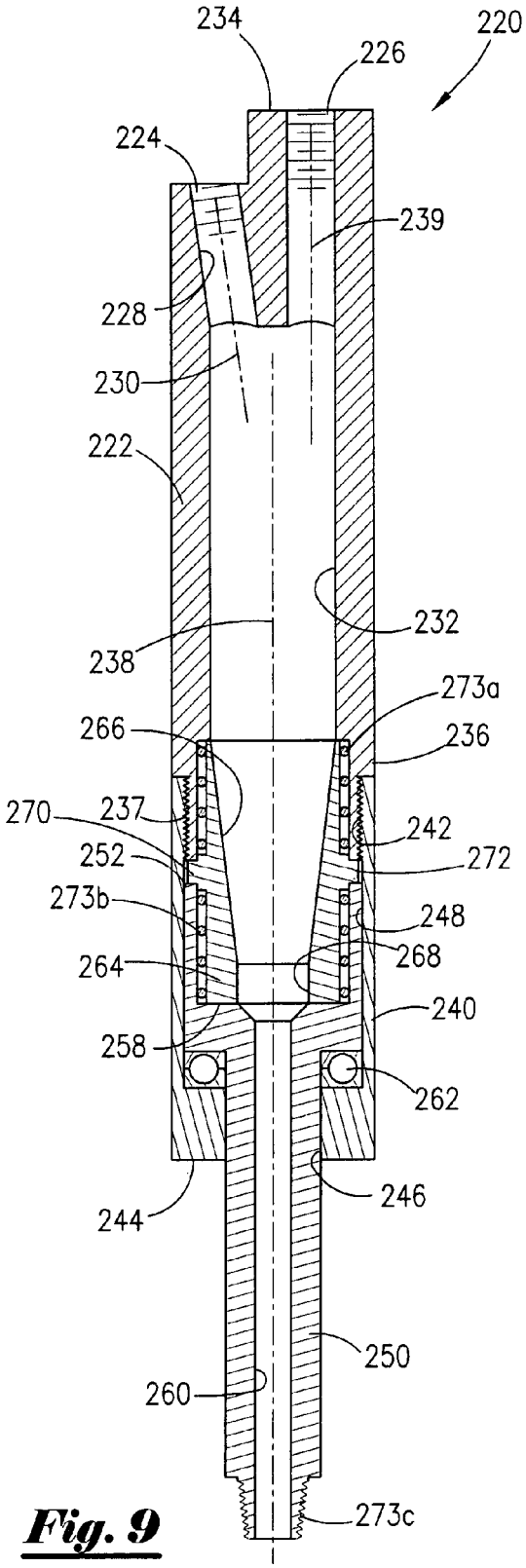
FIG. 9 is a cross-sectional view of the most preferred embodiment of the side entry apparatus of the present disclosure.

Referring now to FIG. 9, a cross-sectional view of the most preferred embodiment of the side entry apparatus 220 of the present disclosure will now be described. FIG. 9 includes the main body 222 that contains a first entry port 224 and a second entry port 226. The main body 222 is generally a cylindrical member. The first entry port 224 has a bore 228 having a center axis denoted by the numeral 230, and wherein the bore 228 leads to the main body bore 232. The main body 222 has a proximate end, seen generally at 234, and a distal end, seen generally at 236, and wherein the distal end 236 contains external thread means 237. Additionally, the main body bore 232 has a center of axis denoted by the numeral 238. The second entry port 226 has a center of axis 239, and as shown, is parallel to axis 237.

FIG. 9 further depicts the bearing nut 240 that has a first end containing internal thread means 242, and wherein the internal thread means 242 will engage with the external thread means 237 of distal end 236. The bearing nut 240 is generally cylindrical and has a center of axis that is aligned with the center of axis 238 of the main body. The bearing nut 240 has a second radial end 244, and wherein the second end 244 contains a center opening 246. As seen in FIG. 9, the bearing nut 240 contains an internal bore portion 248.

Figure 11:
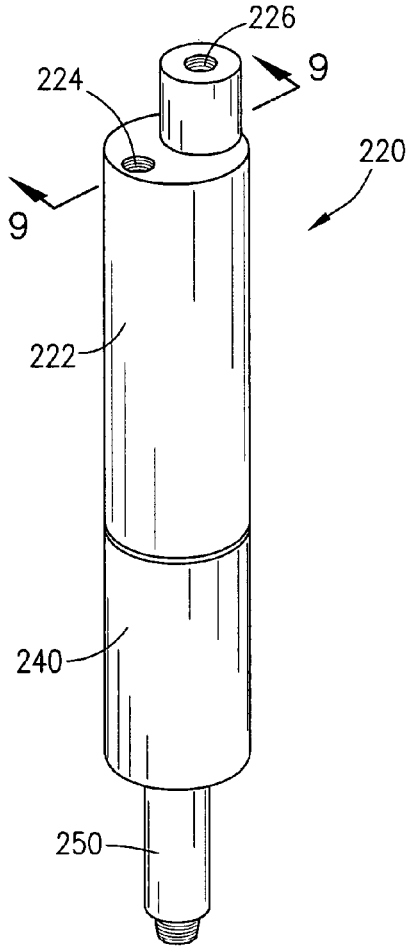
FIG. 11 is a perspective view of the most preferred embodiment of side entry apparatus seen in FIG. 9.
Figure 10:
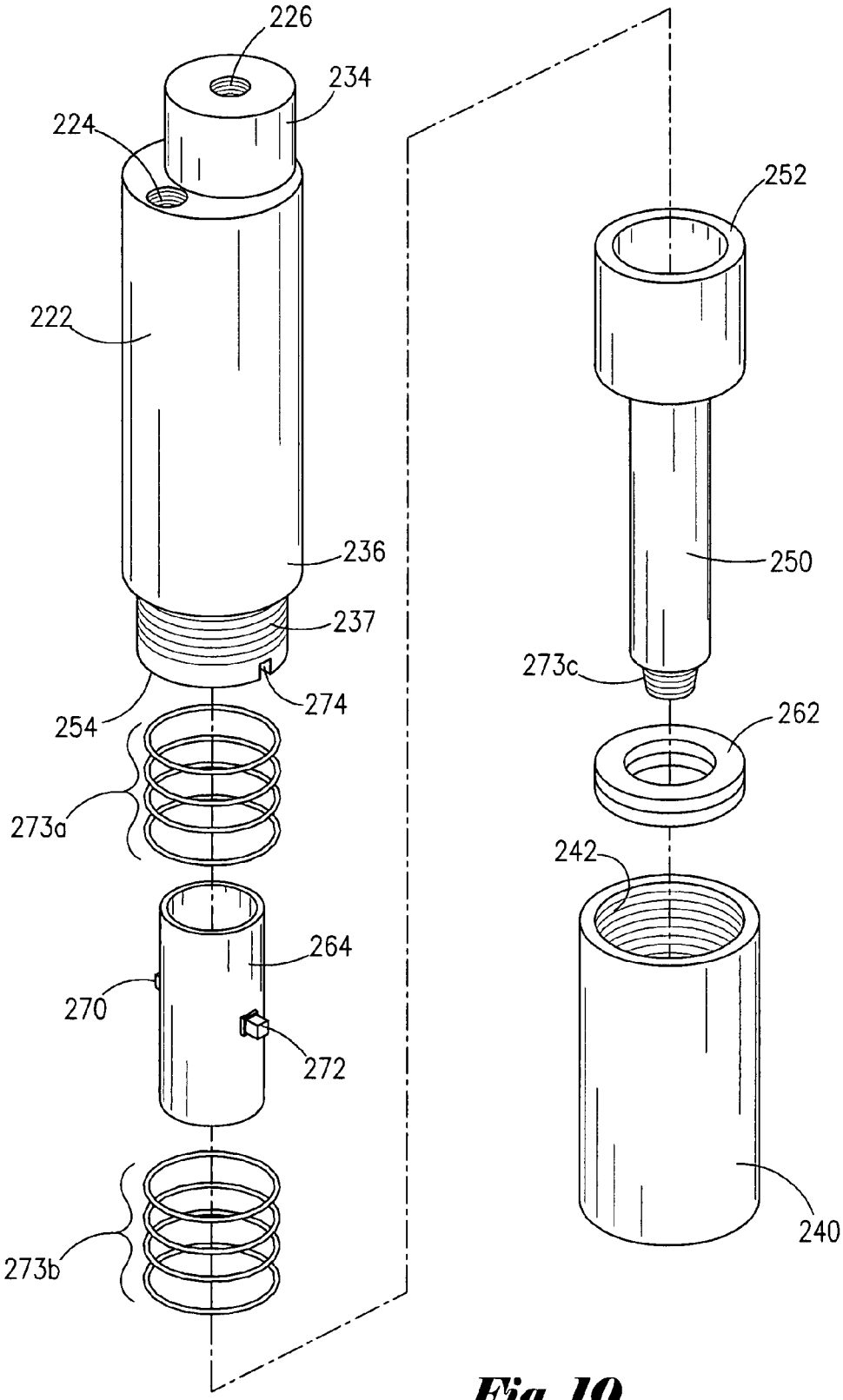
FIG. 10 is an exploded view of the most preferred embodiment of the side entry apparatus seen in FIG. 9.

It should be noted that in the preferred embodiment, and as seen in FIGS. 9, 10 and 11, the outer diameter of the main body forms a cylinder and wherein the inner diameter of the main body also forms a cylinder, and wherein the outer diameter of the main body is parallel with the inner diameter of the main body so that a fully opened inner diameter bore is formed. Prior art entry tools have angled outer diameters and angled inner diameters.

As seen in FIG. 10, a mandrel 250 is also included, and wherein the mandrel 250 has a first end 252 that abuts the radial end 254 of the main body 222. Returning to FIG. 9, the mandrel 250 is essentially cylindrical and also has a center of axis that is aligned with the center of axis 238 of the main body 222. Extending inward from the first end 252 is an internal bore portion 248 that extends to the inwardly oriented radial surface 258 which in turn extends to the inner bore surface 260.

FIG. 9 also depicts the roller bearing means 262 for allowing rotation of the mandrel 250 relative to the main body 222. The sleeve 264 is disposed within the main body 222 and the mandrel 250, and in particular, the sleeve 264 is disposed within a reciprocal bore configured from the internal portion of the main body 222 and the mandrel 250. The sleeve 264 contains an internal conical surface 266 (sometimes referred to as the throat 266) that extends to the internal bore portion 268 (sometimes referred to as the neck 268). A first prong 270 and a second prong 272 are formed on the outer portion of the sleeve 264, and wherein these prongs 270, 272 will engage a reciprocal indentation on the main body 222. The purpose of the prongs 270, 272 are to engage the indentations on the main body 222 so that when the mandrel 250 rotates, the sleeve 264 is held stationary; otherwise, the wireline runs the risk of being cut when the mandrel 250 is rotated since the sleeve 264 would have a tendency to also want to rotate, thereby enhancing the chance of the wireline being cut. Also included is the upper (first) seal means 273*a* for sealing the inner portion of the apparatus 220 from well pressure escaping, as well as the lower (second) seal means 273*b* for sealing the inner portion of the apparatus 220 from well pressure escaping. It should be noted that mandrel 250 has external threads 273*c* at the bottom end for connecting to the works string and the first and second entry ports 224, 226 also have internal threads for connections to the appropriate components such as the lubricators.

Referring now to FIG. 10, an exploded view of the most preferred embodiment of the side entry apparatus seen in FIG. 9 will now be described. The first entry port 224 and the second entry port 226 are shown on the main body 222. The indentation 274 on the main body 222 will engage the prong 272 for holding in place to prevent the sleeve for rotating, as previously mentioned. FIG. 10 also depicts the radial end 252 that will abut the radial end 254 of the main body 222. As noted earlier, the internal threads 242 of the bearing nut 240 will engage with the external threads 237.

FIG. 11 is a perspective view of the most preferred embodiment of side entry apparatus 220 seen in FIG. 9. FIG. 11 depicts the main body 222 threadedly connected to the bearing nut 240, with the mandrel 250 extending from the bearing nut 240.

Figure 12:
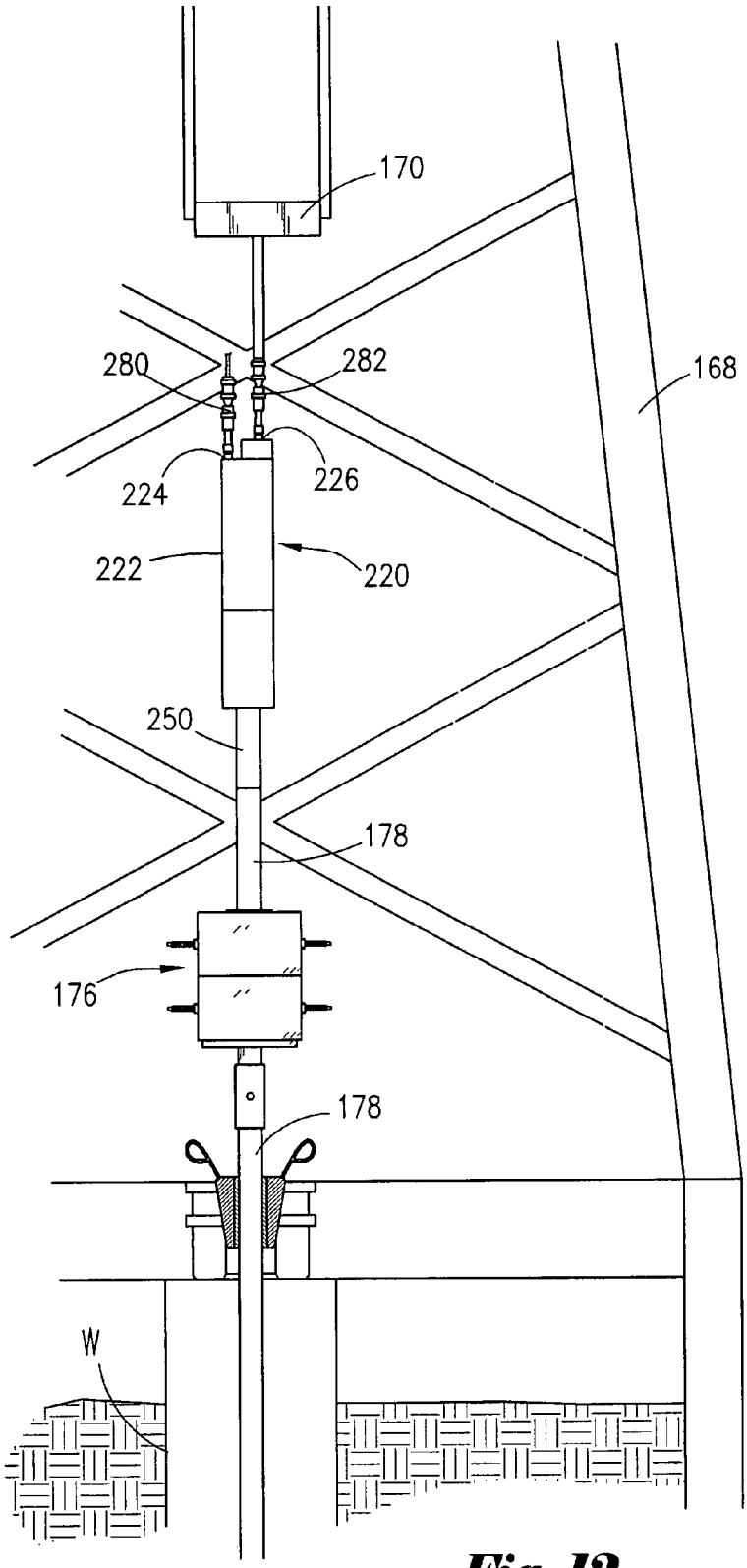
FIG. 12 is a schematic illustration of the side entry apparatus positioned within a derrick, with the derrick being operatively associated with a well.

In the preferred embodiment, the side entry apparatus 220 is positioned within a derrick 168. FIG. 12 depicts a schematic illustration of a work string 178 connected to the mandrel 250, a wireline lubricator 280 being connected to the port 224 and work string lubricator 282 being connected to the port 226. The work string lubricator 282 is connected to the top drive mechanism 170, and wherein the top drive mechanism 170 is attached to the derrick 168 using conventional means. The BOP 176 is operatively associated with the work string 178. In this way, remedial well work can be accomplished, and various procedures undertaken, with the capability of rotating the work string 178 while maintaining the main body 222 (and the associated work string lubricator) stationary, according to the teachings of this disclosure.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. An apparatus for use with a wireline on a drilling rig, the apparatus comprising:

a main body having an integral first entry port and an integral second entry port, wherein said first entry port is configured to receive the wireline, said main body having a proximate end and a distal end, said main body having an internal bore having an axis and wherein said second entry port is aligned with said axis and said first entry port is aligned at an angle to said axis;

a bearing nut threadably engaged with said distal end of said main body;

a mandrel operatively associated with the distal end of said main body, wherein said mandrel is disposed within said bearing nut so that said mandrel is capable of rotating;

wherein an internal portion of said main body and an internal portion of said mandrel cooperate to form a receptacle bore, and wherein the apparatus further comprises:

a sleeve non-rotatably disposed within said receptacle bore, such that said sleeve does not rotate when said mandrel rotates.

2. The apparatus of claim 1 wherein said mandrel and said bearing nut cooperate to form an annular cavity and wherein the apparatus further comprises:

a plurality of roller bearings disposed within said annular cavity in order to facilitate rotation of said mandrel.

3. The apparatus of claim 2 further comprising:

a first seal means, disposed about said sleeve and engaging said internal portion of said main body, for sealing the internal portion of said main body.

4. The apparatus of claim 3 further comprising:

a second seal means, disposed about said sleeve and engaging said internal portion of said mandrel, for sealing the internal portion of said mandrel.

5. The apparatus of claim 4 wherein an internal bore of said sleeve contains a conical surface, and wherein said internal bore has a neck and a throat, said neck disposed above said throat, and wherein said neck has a larger inner diameter than the throat.

6. The apparatus of claim 5 wherein said sleeve contains a shoulder for engaging an indentation on said internal bore of said main body, and wherein said shoulder is capable of holding the sleeve stationary when the mandrel is rotated.

7. The apparatus of claim 6 wherein said second entry port is connected to a top drive of the drilling rig.

8. The apparatus of claim 7 wherein said mandrel is connected to a drilling string.

9. An apparatus for use with a wireline on a drilling rig, the apparatus comprising:

a main body having an integral first entry port and an integral second entry port, wherein said first entry port is configured to receive the wireline, said main body having a proximate end and a distal end, and wherein a second entry port axis is disposed at an offset angle relative to a first entry port axis;

a bearing nut threadably engaged with said distal end of said main body;

a mandrel operatively associated with the distal end of said main body, wherein said mandrel is disposed within said bearing nut so that said mandrel is capable of rotating, and wherein an internal portion of said main body and an internal portion of said mandrel cooperate to form a receptacle bore; and a sleeve non-rotatably disposed within said receptacle bore, such that said sleeve does not rotate when said mandrel rotates.

10. The apparatus of claim 9 wherein said mandrel and said bearing nut cooperate to form an annular cavity and wherein the apparatus further comprises:

a plurality of roller bearings disposed within said annular cavity in order to facilitate rotation of said mandrel.

11. The apparatus of claim 10 further comprising:

a first seal, disposed about said sleeve and engaging said internal portion of said main body, for sealing the internal portion of said main body.

12. The apparatus of claim 11 further comprising:

a second seal, disposed about said sleeve and engaging said internal portion of said mandrel, for sealing the internal portion of said mandrel.

13. The apparatus of claim 12 wherein said sleeve contains an internal conical surface, and wherein said internal conical surface has a neck and a throat said neck disposed above said throat, and wherein said neck has a larger diameter than the throat.

14. The apparatus of claim 13 wherein said sleeve contains a shoulder for engaging an indentation on said internal portion of said main body, and wherein said shoulder is configured to hold the sleeve stationary when the mandrel is rotated.

15. The apparatus of claim 14 wherein said mandrel contains a chamfered inner bore that is configured to engage the neck of said sleeve so that the wireline does not engage the internal portion of the mandrel.

16. The apparatus of claim 15 wherein said second entry port is connected to a top drive of the drilling rig.

17. The apparatus of claim 16 wherein said mandrel is connected to a drilling string.

18. The apparatus of claim 13 wherein the outer diameter of said main body forms a cylinder and wherein the inner diameter of said main body also forms a cylinder, and wherein said outer diameter of said main body is parallel with said inner diameter of said main body so that a fully opened inner diameter bore is formed.

19. A method of performing wireline work on a drilling rig, the method comprising:

providing a entry tool, wherein the entry tool comprises: a main body having an integral first entry port and an integral second entry port, wherein said first entry port is configured to receive the wireline, said main body having a proximate end and a distal end; a bearing nut threadably engaged with said distal end of said main body; a mandrel operatively associated with the distal end of said main body, wherein said mandrel is disposed within said bearing nut so that said mandrel is capable of rotating, and wherein an internal portion of said main body and an internal portion of said mandrel cooperate to form a receptacle bore; a sleeve non-rotatably disposed within said receptacle bore; a plurality of roller bearings disposed within an annular cavity formed between said mandrel and said bearing nut;

connecting said second entry port to a top drive of the drilling rig;

connecting said mandrel to a drilling string;

lowering a downhole tool on the wireline;

rotating the drilling string via the plurality of roller bearings;

rotating the mandrel about the plurality of roller bearings; and maintaining the main body stationary.

20. The method of claim 19 wherein the step of lowering the tool on the wireline includes protecting the wireline from being cut on a chamfered surface contained on the mandrel.

* * * * *